US005265836A

United States Patent [19]

Dale

[11] Patent Number: 5,265,836

[45] Date of Patent: Nov. 30, 1993

[54] CONCRETE FORM

[75] Inventor: Charles E. Dale, Ballwin, Mo.

[73] Assignee: Dale, Cox & Simon, St. Louis, Mo.

[21] Appl. No.: 907,158

[22] Filed: Jul. 1, 1992

[51] Int. Cl.[5] ..... E04G 9/00

[52] U.S. Cl. ..... 249/191; 249/192; 249/196

[58] Field of Search ..... 249/44, 45, 47, 191, 249/192, 196

[56] References Cited

U.S. PATENT DOCUMENTS

| | | | |
|---|---|---|---|
| 1,640,997 | 8/1927 | Hollister | 249/192 |
| 2,008,162 | 7/1935 | Waddell | 249/196 |
| 2,297,899 | 10/1942 | Krueger | 249/45 |
| 2,526,381 | 10/1950 | Mathis | 249/196 |
| 2,845,685 | 8/1958 | Lovgren et al. | 249/192 |
| 3,204,918 | 9/1965 | Bonin et al. | 249/191 |
| 3,327,987 | 6/1967 | Müller | 249/47 |
| 3,362,676 | 1/1968 | Bowden | 249/192 |
| 3,414,230 | 12/1968 | Brosseau | 249/193 |
| 3,429,547 | 2/1969 | Schimmel | 249/192 |
| 3,791,615 | 2/1974 | Ewing | 249/196 |
| 4,235,411 | 11/1980 | Maier | 249/193 |
| 4,695,033 | 9/1987 | Imaeda et al. | 249/192 |
| 4,948,088 | 8/1990 | Schwörer | 249/196 |

FOREIGN PATENT DOCUMENTS

| | | | |
|---|---|---|---|
| 2747064 | 5/1979 | Fed. Rep. of Germany | 249/196 |
| 773605 | 11/1934 | France | 249/196 |

*Primary Examiner*—Jay H. Woo
*Assistant Examiner*—James P. Mackey
*Attorney, Agent, or Firm*—Rogers, Howell & Haferkamp

[57] ABSTRACT

A standardized concrete form includes a series of rectangular slots spaced along the sides thereof and which extend virtually the entire length thereof which, along with mounting holes, permits the standardized hardware pins to join adjacent concrete forms at virtually an infinitely variable step height therebetween. The standardized mounting holes are formed in cloverleaf shape in order to accommodate and facilitate the insertion of hardware pins when adjacent forms are slightly misaligned.

12 Claims, 2 Drawing Sheets

FIG. 1.
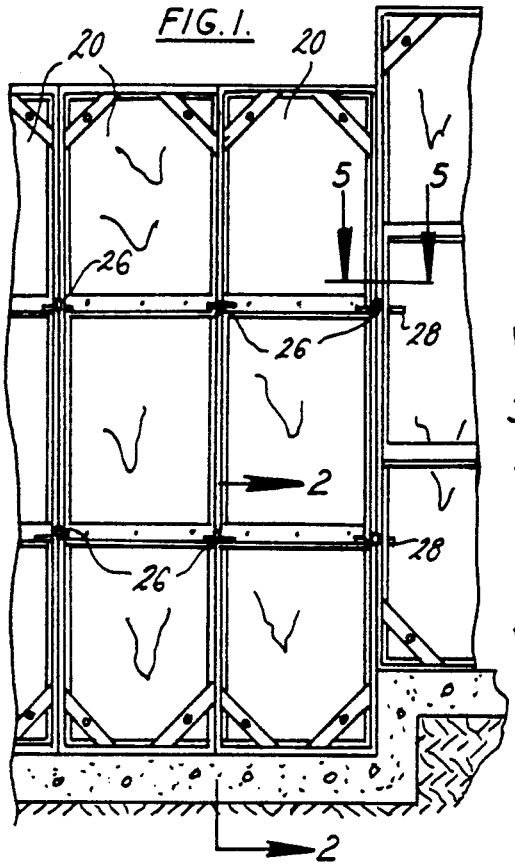
FIG. 2.
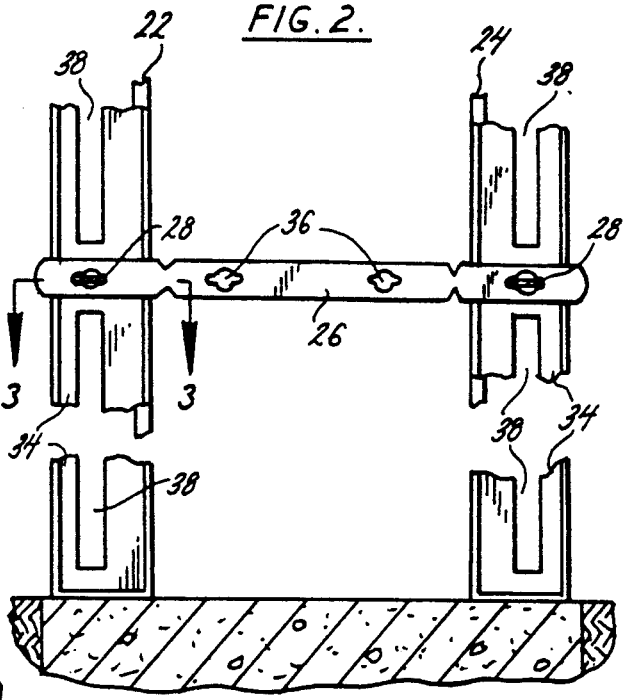
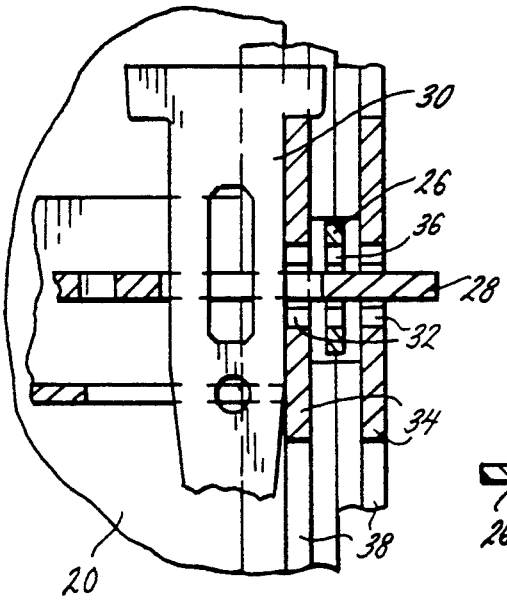
FIG. 4.
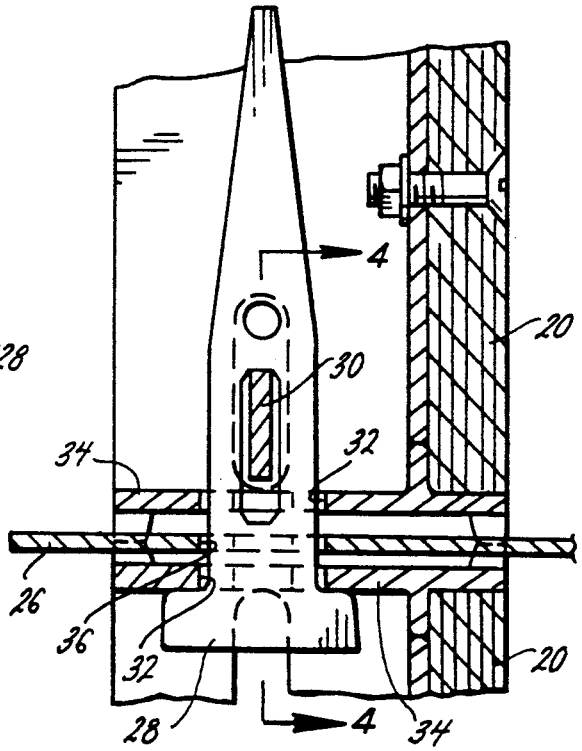
FIG. 3.

CONCRETE FORM

BACKGROUND AND SUMMARY OF THE INVENTION

Concrete forms are well known in the prior art as used to construct foundation walls for homes, commercial buildings, and the like. Generally, a concrete form consists of a rectangular shaped steel frame approximately two feet wide by eight feet long formed by a two and one-half inch steel plate around the circumference thereof. A small ridge or lip of approximately one-half inch depth is formed around the periphery to hold a sheet of plywood in place therein. The sheet of plywood is supported along its back by metal angles placed at approximately two foot intervals beginning at one foot from the top and bottom of the form.

A plurality of forms are built into two discrete parallel lines between which is poured the concrete which sets up into the completed wall. Adjacent forms are joined to form the walls by hardware which is inserted between matching small rectangular holes cut into the sides of the forms approximately every six inches. Typically, the hardware used at each matched set of holes comprises a pair of slotted pins, one of which is inserted horizontally through the pair of matching rectangular holes and the second of which is inserted vertically through a slot in the first pin. Lastly, a number of "ties" extend between the two walls of the forms and are also secured in place by the hardware. These ties help to hold the forms a constant distance apart and prevent their spreading as the concrete is poured. Typical examples of these forms are found in U.S. Pat. Nos. 3,362,676 and 3,204,918.

Although these forms have been in wide use in the construction industry for many years, there are a number of problems associated with them. Because of the way the adjacent forms are joined or secured to each other, adjacent forms must be almost exactly level. Of course, this requires great attention to excavating and preparing the foundation wall site. However, even with this attention, there are many building sites which have a sloping terrain in which it is not possible to pour an entire length of foundation wall with the same footing elevation. For those installations, a step size can be accommodated, but only in increments equal to the spacing between adjacent rectangular holes in the mold sidewalls. In other words, adjacent panels may be vertically offset from each other by six inches, or a multiple thereof, such that every slot in the side of one concrete form is offset but matches with a corresponding hole in the side of the adjacent concrete form. Of course, not all terrains readily accommodate this step size. Furthermore, much attention must be paid to maintaining or preparing the footing for this step. In common practice, steps of odd sizes are accommodated by "shimming" two-by-fours under a form and other two-by-fours are used to "scab" together the adjacent forms as the attaching hardware will not work as the mounting holes are not aligned. As can be appreciated, this is highly undesirable in that much additional work is required to prepare the forms and there is a much greater likelihood that forms will slip, concrete will be poured improperly, and clean-up work will have to be done to finish off the foundation floor or wall.

The inventor herein is aware of at least two patents which disclose attempts in the prior art at solving the problem of a variable step between adjacent forms.

These are U.S. Pat. Nos. 3,429,547 and 4,235,411. The '547 patent discloses a transition member formed of two panel members which are slidingly locked together in a tongue-and-groove arrangement. This transition member fits between two standard sized forms and permits a variable step between these standard concrete form panels. The '411 patent also discloses a transition member which has a slot extending the entire height of each side thereof and special key lock type hardware is used to fit through special cross-shaped holes in the sides of the concrete forms. The key lock is inserted through the cross-shaped holes in the concrete forms, into the transition member slot, and is rotated to lock against the lips which form the vertical slot in the transition member. Both of these prior art disclosures are for a transition member of a particularized and specialized construction. The standardized form is continued to be used, but there is no provision or suggestion as to how a standardized form itself can be used without these specialized transition members, and their attendant specialized hardware. Furthermore, these transition members throw off the standard sizing of the concrete forms, which are typically two feet by eight feet. Therefore, although applicants have become aware of these prior art disclosures as shown in patents, they are not aware of either one of these constructions being actually made and used in the field.

In order to solve these and other problems in the prior art, the inventors herein have succeeded in designing and developing a modification to a standard two-by-eight foot concrete form which permits it to be virtually infinitely variable in alignment between adjacent concrete forms, and yet still be securely fastened together. This invention eliminates the requirement for any transitions, special hardware, or any additional special provisions which must be separately made and installed on the job site. Furthermore, the present invention facilitates the insertion of standardized mounting hardware pins between adjacent concrete forms. As explained above, the rectangular holes provided in the sides of the concrete forms in the prior art required the ground to be almost exactly level such that they would align as they are typically sized to be only slightly larger than the mounting pins themselves. Of course, on the job and in the field, this type of control of a dirt surface which has been excavated is somewhat difficult. Therefore, the inventors herein have developed a cloverleaf shaped slot for the mounting hardware which facilitates the insertion of the mounting pin should one concrete form be slightly offset up or down from its adjacent form. As the pins have a tapered nose, it may be inserted or started into the matched openings and a hammer then used to drive the pin home and thereby level the adjacent forms. This greatly minimizes the amount of manpower needed to place and align adjacent concrete forms over the construction commonly found in the prior art.

In order to provide virtually an infinitely variable step length between adjacent concrete forms, rectangular slots are cut between adjacent cloverleaf mounting holes in each side and, in some cases, top and bottom of the standardized concrete form. These rectangular slots are substantially the same width as the mounting hardware pin and extend substantially the entirety of the distance between adjacent cloverleaf shaped mounting holes. In use, if one concrete form is offset from an adjacent form, the mounting hardware may be inserted through the rectangular slot on one side and the cloverleaf hole on the other side, or vice versa, and still held in place by the second hardware pin which slides through the slot in the first hardware pin. Thus, irregularly offset adjacent concrete forms may be readily joined to each other in a safe and secure fashion. This greatly minimizes the amount of surface preparation which must be made to accommodate sloping terrains requiring steps greater or less than the standard spacing between adjacent mounting holes, typically six inches in the prior art.

While the principal advantages and features of the present invention have been described above, a more complete and thorough understanding of the invention may be attained by referring to the drawings and description of the preferred embodiment which follow.

BRIEF DESCRIPTION OF THE DRAWINGS

FIG. 1 is a side view of a plurality of concrete forms assembled to accommodate a step height at variance with standard spacing of adjacent mounting holes;

FIG. 2 is a partial cross-sectional view taken along the plane of line 2—2 in FIG. 1 and detailing the mounting of a tie between adjacent form walls;

FIG. 3 is a partial cross-sectional view taken along the plane of line 3—3 in FIG. 2 and detailing the attachment of mounting hardware to adjacent forms and a tie;

FIG. 4 is a partial cross-sectional view taken along the plane of line 4—4 in FIG. 3 further detailing the attachment of mounting hardware to adjacent concrete forms;

DETAILED DESCRIPTION OF THE PREFERRED EMBODIMENTS

Figure 5:
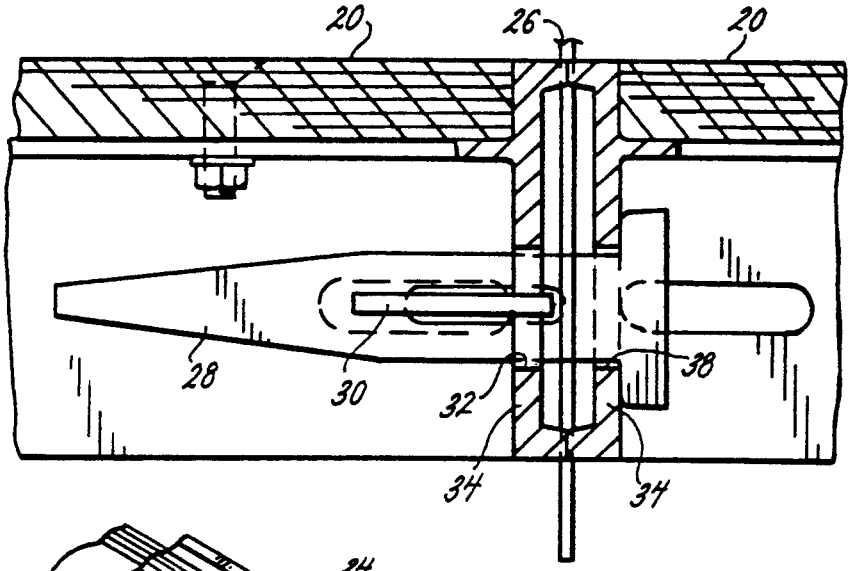
FIG. 5 is a partial cross-sectional view taken along the plane of line 5—5 in FIG. 1.
Figure 6:
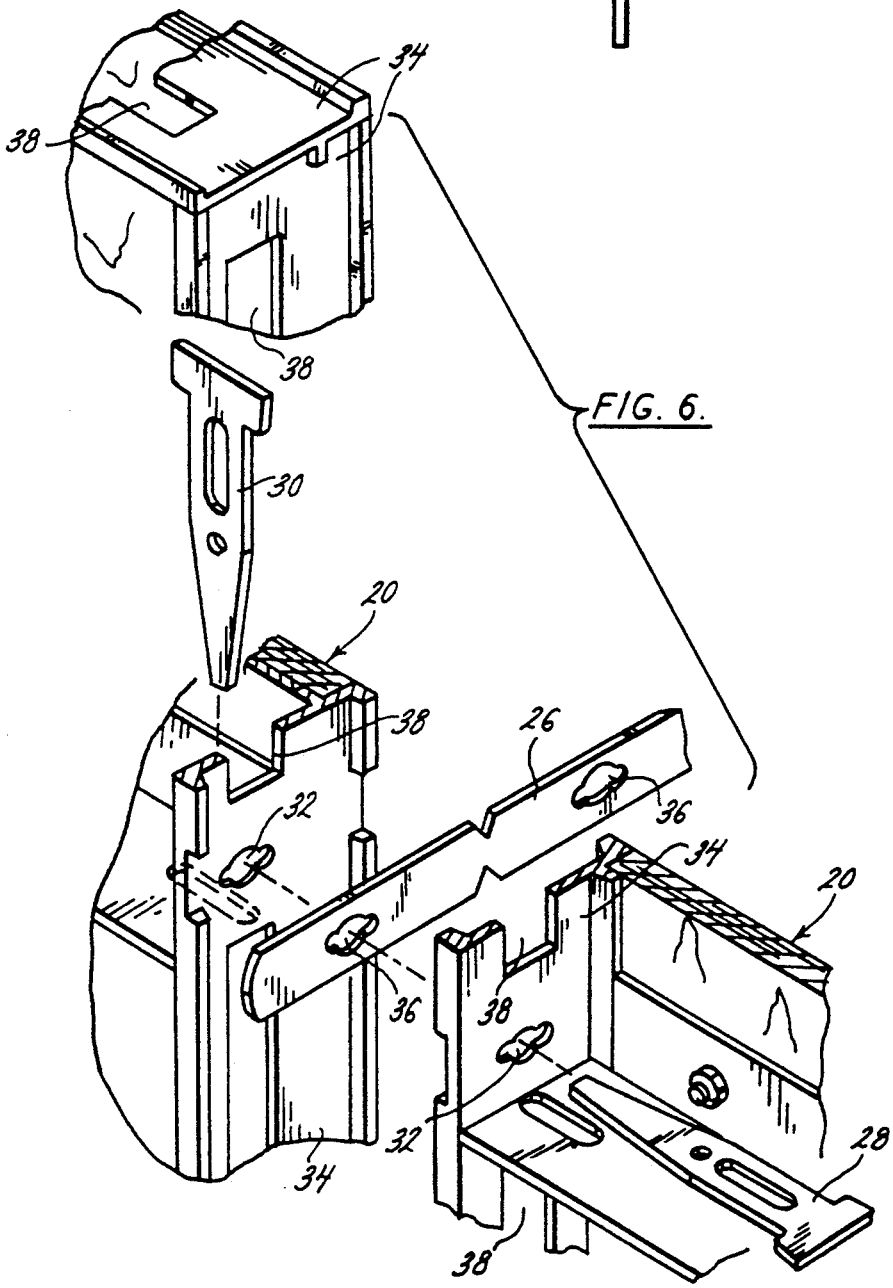
FIG. 6 is a perspective fragmentary exploded view of adjacent concrete forms with mounting hardware and a tie further detailing their assembly.

As shown in FIG. 1, a plurality of concrete forms may be arranged both vertically and horizontally in a pair of spaced apart walls to form an interior space for the pouring of a foundation wall or the like of concrete. As shown in greater detail in FIG. 2, a first wall 22 is spaced apart from a second wall 24 formed of plywood which fits within a lip of each concrete form 20. Typically, in the prior art, these concrete forms may be two feet by eight feet, or some other standardized dimension. A plurality of ties 26 extend between the spaced apart walls 22, 24 and help to stabilize and control the distance therebetween to ensure a true and plumb construction.

As best shown in FIGS. 3–6, a pair of hardware pins 28, 30 are used to join adjacent concrete forms 20. One hardware pin 28 is inserted horizontally through a cloverleaf shaped mounting hole 32 formed in each side 34 of the concrete form 20. Ideally, and for straight runs, these cloverleaf shaped mounting holes 32 are aligned between adjacent concrete forms 20. Of course, as required, ties 26 are also placed between adjacent concrete forms 20 and may also have a cloverleaf shaped hole 36 through which hardware pin 28 is inserted. For those situations where less than a true level surface runs beneath the adjacent concrete forms 20, the cloverleaf shaped mounting holes 32, 36 permit the horizontally driven hardware pin 28 to align the adjacent concrete forms 20 and tie 26, as necessary.

Spaced between adjacent mounting holes 32, and at the end of each concrete form 20, is a rectangular slot 38. As shown in the drawings, rectangular slot 38 extends substantially the entirety of the distance between adjacent mounting holes 32, and the end of the side 34. Rectangular slots 38 may be cut into all four sides of concrete form 20 to thereby provide variable offset capability both vertically and horizontally. As shown in FIG. 5, the horizontal hardware pin 28 may be inserted through a rectangular slot 38 and a mounting hole 32 in order to secure adjacent concrete forms 20 at some offset at variance with, or irregular from, the standardized spacing commonly used between adjacent mounting holes 32. Typically, in the prior art, concrete forms 20 have adjacent mounting holes 32 spaced at a nominal six inches therebetween. As explained above, while this spacing accommodates steps in a foundation floor of six inches, or increments thereof, any other step height is not accommodated by that construction. For those instances, the rectangular slots 38 may be used in conjunction with the mounting holes 32 to provide for securing adjacent concrete forms 20 with the standard hardware pins 28, 30.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a concrete form for constructing a wall, said form being adapted for arrangement in a first plurality as a first wall so that their sides are aligned in adjacent manner to form a first surface and a second plurality as a second wall to form a second surface, said first and second surfaces being spaced apart to thereby define the faces of said constructed wall, and a plurality of holes spaced at substantially regular intervals in the sides of said forms so that hardware may be inserted therethrough to secure adjacent forms together, the improvement comprising a plurality of substantially rectangular slots spaced along at least one side of said form, at least one of said slots being located between each pair of adjacent holes, and between the end of said side and a mounting hole, said slots having their longest dimension running substantially parallel to the sides of said form so that said hardward may be inserted through said slots at any point therealong to thereby secure adjacent forms which are offset from each other.

2. The form of claim 1 wherein each of said slots extends for substantially the entirety of the distance between adjacent holes, or between a hole and the end of the side.

3. The form of claim 2 wherein said slots have substantially the same width as said holes so that said hardware may be readily inserted through a hole in one form and a slot in its adjacent form.

4. The form of claim 3 wherein at least some of said holes are cloverleaf shaped to thereby facilitate the insertion therethrough of said hardward between forms which are minimally offset.

5. The form of claim 4 wherein said slots are spaced along all four sides of said four.

6. The form of claim 5 further comprising a plurality of ties for extending between said walls, said ties having openings therein for matching and lining up with said holes and slots to thereby be secured by said hardware.

7. In a concrete form for erection into two opposing walls, with the sides of adjacent forms being secured together, for pouring a vertical wall of concrete therebetween, the improvement comprising means in the sides of said forms for securing together the sides of adjacent forms which are offset an irregularly variable distance from each other, said securing means comprising a plurality of substantially rectangular slots, said slots having their long dimension substantially parallel to the sides of said forms, and a plurality of holes, adjacent holes being separated by at least one of said slots, and at least one of said slots being situated adjacent each end of said side, and hardware for insertion through said holes and slots.

8. The form of claim 7 wherein said holes are substantially cloverleaf shaped to thereby facilitate the insertion therethrough of said hardware.

9. In a concrete form for erection into two opposing walls, with the sides of adjacent forms being secured together, for pouring a vertical wall of concrete therebetween, the improvement comprising a plurality of cloverleaf shaped holes spaced along the sides of said forms, a plurality of substantially rectangularly shaped slots with at least one of said slots being located between adjacent holes, and between the end of each side and a hole, said holes and slots facilitating the insertion therethrough of hardware between slightly offset adjacent forms.

10. The form of claim 9 wherein each of said slots extends for substantially the entirety of the distance between adjacent holes, or between a hole and the end of the side.

11. The form of claim 10 wherein said slots have substantially the same width as said holes so that said hardware may be readily inserted through a hole in one form and a slot in its adjacent form.

12. The form of claim 11 wherein said holes are spaced at substantially regular intervals along all four sides of said form.

* * * * *